United States Patent [19]

Fletcher et al.

[11] 4,342,645

[45] Aug. 3, 1982

[54] METHOD OF REREFINING USED LUBRICATING OIL

[75] Inventors: Laird C. Fletcher, Natchitoches; Harold J. Beard, Baton Rouge, both of La.

[73] Assignee: Delta Central Refining, Inc., Natchitoches, La.

[21] Appl. No.: 202,019

[22] Filed: Oct. 28, 1980

[51] Int. Cl.[3] ..... C10M 11/00; C10G 7/06

[52] U.S. Cl. ..... 208/184; 208/355

[58] Field of Search ..... 208/184, 355

[56] References Cited

U.S. PATENT DOCUMENTS

| | | |
|---|---|---|
| 1,584,588 | 5/1926 | Acheson . |
| 2,583,620 | 1/1952 | Wrightson . |
| 3,024,171 | 3/1962 | Bone . |
| 3,173,859 | 3/1965 | Chambers . |
| 3,305,478 | 2/1967 | Gilson et al. . |
| 3,450,627 | 6/1969 | Johnson et al. . |
| 3,607,731 | 9/1971 | Gulick . |
| 3,620,967 | 11/1971 | Gulick . |
| 3,625,881 | 12/1971 | Chambers et al. . |
| 3,763,036 | 10/1973 | Jordan et al. . |
| 3,773,658 | 10/1973 | Vu et al. . |
| 3,791,965 | 2/1974 | Fitzsimons et al. . |
| 3,864,242 | 2/1975 | Watanabe . |
| 3,870,625 | 3/1975 | Wielezynski . |
| 3,879,282 | 4/1975 | Johnson . |
| 3,919,076 | 11/1975 | Cutler et al. . |
| 3,923,643 | 12/1975 | Lewis et al. . |
| 3,929,626 | 12/1975 | Button et al. . |
| 3,954,602 | 5/1976 | Troesch et al. . |
| 3,980,551 | 9/1976 | Wolk . |
| 3,985,642 | 10/1976 | Friel et al. . |
| 4,021,333 | 5/1977 | Habiby et al. . |
| 4,029,569 | 6/1977 | Ivey, Jr. . |
| 4,033,859 | 7/1977 | Davidson et al. . |
| 4,038,176 | 7/1977 | Noren et al. . |
| 4,045,330 | 8/1977 | Avrillon et al. . |
| 4,071,438 | 1/1978 | O'Blasny . |
| 4,073,719 | 2/1978 | Whisman et al. . |
| 4,073,720 | 2/1978 | Whisman et al. . |
| 4,097,369 | 6/1978 | Ebel et al. . |
| 4,101,414 | 7/1978 | Kim et al. . |
| 4,105,538 | 8/1978 | Mattox . |
| 4,124,492 | 11/1978 | Fung et al. . |
| 4,140,212 | 2/1979 | O'Blasny et al. . |
| 4,191,640 | 3/1980 | Chess ..... 208/355 |

FOREIGN PATENT DOCUMENTS

| | | |
|---|---|---|
| 49-69702 | 7/1974 | Japan . |
| 7711298 | 4/1979 | Netherlands ..... 208/184 |

OTHER PUBLICATIONS

"Evaporators: Use in Re-refining", published in *Hydrocarbon Processing*, Jul. 1979.

"Waste Lubricating Oil Research", published in *Bureau of Mines Report of Investigations*, 1974-RI 7884, RI 7925.

*Reprocessing and Disposal of Waste Petroleum Oils*, by L. Y. Hess, published by Noyes Data Corporation.

*Petroleum Refinery Engineering*, by W. L. Nelson, published by McGraw-Hill Book Company.

*Primary Examiner*—T. M. Tufariello

*Attorney, Agent, or Firm*—Winburn & Gray, Ltd.

[57] ABSTRACT

Used oil is refined by distillation to remove a volatile forecut followed by further distillation with recirculation provisions to obtain the desired fractions of lubricating oil products while reducing the vaporization temperature of the oil. The recycle effect tends to reduce coking and cracking while providing a greater recovery of lubricating oil products through the carrier effect of the light ends.

In one embodiment of the invention, a waste oil feedstock has water, gasoline and other similarly volatile components removed in a first stage evaporator (16). Heavier fuel, such as fuel oil is then removed in a second stage evaporator (28). A light lube oil fraction is then obtained by distillation with a third stage wiped-film evaporator (40). Finally, a heavy lube oil fraction is obtained by distillation of the bottoms from the evaporator (40) with a fourth-stage evaporator (64).

20 Claims, 3 Drawing Figures

METHOD OF REREFINING USED LUBRICATING OIL

TECHNICAL FIELD

This invention relates to the rerefining of used lubricating oil. More particularly, this invention relates to the rerefining of used lubricating oil by distillation.

BACKGROUND OF THE INVENTION

This invention relates to a process for the reclamation and rerefining of waste hydrocarbon lubricating oils. In particular, the invention provides a process which is simple and reduces coking, cracking and fouling tendencies that are inherent in other rerefining processes.

Large and increasing volumes of used lubricating oil, particularly crankcase oils from diesel and internal combustion engines are produced each year. These waste oils are contaminated with oxidation and degradation products, water, fine particulates, metal and carbon and oil additive products. These contamination components render the oils unsuitable for continued use. Waste oils have generally been disposed of by incineration, in landfill, or used in road oiling for dust control, because the cost of reclamation and rerefining has been excessive. However, because of the rising cost of hydrocarbon fuels and lubricants, coupled with the ever-increasing demand and depletion of resources, the need for an efficient, low-cost waste oil rerefining process has arisen.

In recent years some small scale rerefining processes have been put into operation in which marketable oils are recovered. However, due to the high costs involved and the resulting narrow margin of profit, such recovery processes represent a small percentage utilization of the total quantity of used lubricating oils.

The ever-increasing scarcity and consequent high costs of petroleum, particularly high quality lubricating stocks, now presents positive incentives to selectively remove undesirable contaminants from used motor oils and reuse the valuable high quality lubricating components contained in such oils.

Several waste oil rerefining processes are known from the prior art. For example, in U.S. Pat. No. 3,639,229, a process is described where a mixture of an aliphatic monohydric alcohol of from four to five carbon atoms and a light hydrocarbon is added to waste oil. The mixture settles into three distinct layers. The upper oily layer is recovered, treated with sulfuric acid and thereafter refined by conventional means. In U.S. Pat. No. 3,919,076, a process is described that involves removing water from the waste oil, adding a saturated hydrocarbon solvent, settling the mixture to recover the oil/solvent mix, removing the solvent, vacuum distilling the residual oil to collect selected fractions, hydrogenating the fractions over a catalyst, stripping hydrogenated oil to remove light ends and filtering the remaining product. U.S. Pat. No. 4,124,492 discloses a process for reclaiming useful hydrocarbon oil from contaminated waste oil in which the waste oil is dehydrated and, thereafter, the dehydrated oil is dissolved in selected amounts of isopropanol. The undissolved waste matter is separated and the residual oil/solvent fraction is distilled to recover the decontaminated oil and solvent. The recovered oil is further clarified by treatment with a bleaching clay or activated carbon at elevated temperatures. In U.S. Pat. No. 4,021,333, a process is described for rerefining used oil that includes distilling a volatile forecut from the oil, followed by a conventional type of distillation that may occur at reduced pressure. Use of demister means is preferred to minimize carry-over of material into the distillate. The distillation is continued until the desired recovery is obtained. The impurities present in the distillate are extracted.

DISCLOSURE OF THE INVENTION

In accordance with the present invention, a process is provided for rerefining used oil containing lubricating oil. The method in accordance with the present invention reduces the tendency of the used oil to coke, crack, and foul the equipment. Further, a specific type of recycle that forms part of the process also allows greater recovery of lubricating oil products through a "carrier effect" of the light ends.

Thus, in one aspect, the present invention relates to the increased yield of recovered lubricating oil without subjecting the waste oil feedstock to temperatures that create conditions of coking, cracking, or fouling. In another aspect, this invention relates to a process for varying the recycle flow of light ends to achieve the desired viscosity of lubricating oil. Still another aspect of this invention relates to reducing the temperature while achieving the desired recovery of lubricating oil from the waste oil feedstock.

In accordance with another aspect of the present invention, the waste oil feedstock undergoes an initial distillation in which a volatile forecut is removed from the used oil to provide a resulting oil containing lubricating oil. This distillation may also remove water, gasoline and the like, or these components may be removed prior to this distillation. Thereafter, the resulting oil is distilled to form heavy and light fractions, with a portion of the light fraction being recycled and mixed into the resulting oil prior to distillation of the resulting oil in a quantity effective for lowering the vaporization temperature to reduce the tendency of coking, cracking, and fouling during distillation and to increase the recovery of lube oil.

In accordance with another aspect, the present invention further includes distilling the heavy fraction obtained from the distillation of the resulting oil to form a heavy lube fraction and a residual fraction. Further, the distillation of the heavy fraction can also include a recycle of the heavy lube oil fraction into the heavy fraction prior to distillation of the heavy ends for lowering the vaporization temperature to reduce the tendency of coking, cracking and fouling during distillation and to increase the recovery of lube oil. Generally, the amount of distillate recycled to the resulting fraction or heavy fraction prior to distillation is between about 5% and 300% by weight of the fraction to be distilled.

In accordance with another aspect of the present invention, a process is provided in which used oil containing a lubricating oil is rerefined by distilling the used oil to remove a volatile forecut to provide a resulting oil containing lubricating oil. Thereafter, the resulting oil is distilled in an agitated thin film evaporator or a wiped-film evaporator or any other suitable heat transfer device to form heavy and light fractions with lubricating oil being contained in the light fraction. The heavy fraction obtained from the distillation of the resulting oil is further distilled to form a heavy lube fraction and a residual fraction in which an agitated thin film evaporator or a wiped-film evaporator or any other suitable heat transfer device may be used.

BRIEF DESCRIPTION OF DRAWINGS

The invention can be more completely and easily understood by reference to the accompanying drawings in which.

DETAILED DESCRIPTION

Figure 1:
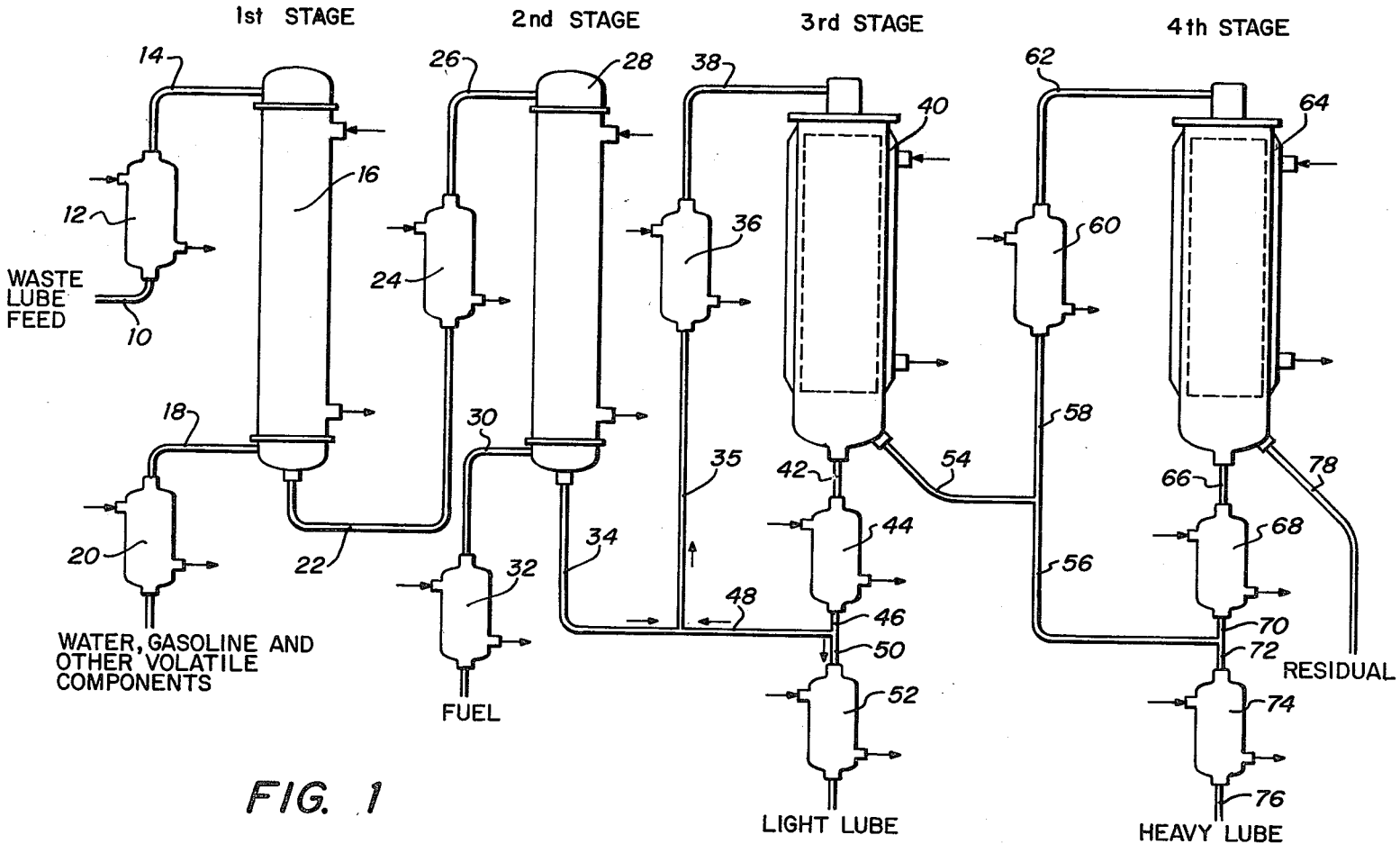
FIG. 1 is a schematic representation of a preferred process flowsheet and apparatus used in conjunction with the present invention.

In accordance with the present invention, an improved process is provided for rerefining used lubricating oil. Thus, in general, the method of this invention is applicable to any used oil that contains lubricating oil. Most often, the used oil that is most readily obtainable is used crankcase oils from motor vehicles, used lubricating oils from machinery, used lubricating oils from equipment, transmission fluids, and other fluids in which the major constituent is an oil of lubricating viscosity. As used in this specification, the oils referred to will be petroleum-based oils (i.e., mineral oils), but it is to be understood that synthetic oils may be substituted therefor.

Broadly stated, the method of this invention includes the following steps for treating used lubricating oil feedstocks which are often collected as drainings from the crankcases of diesel, gasoline, and other types of internal combustion engines. The used oil feedstock is distilled to remove any water, gasoline, and other similarly volatile components therefrom. This first stage generally operates at or near atmospheric pressure, although this is not critical. When the first stage is operated at atmospheric pressure, the feedstock is generally heated in the range between about 220° F. and about 400° F. The optimum temperature for the first stage is dependent on the feedstock contaminants of water and volatile fuels and the residence time allowed for removing these components from the feedstock.

In the second stage, the residue from the first stage is then heated so as to achieve a temperature in the range between about 250° F. and 500° F. The residue from the first stage is then distilled in the second stage to remove a fuel oil cut (components that are heavier and somewhat less volatile than those removed in the first stage). This distillation section preferably operates at a reduced pressure, generally in the range of about 20 to about 150 millimeters mercury absolute. This preferred reduced pressure range and temperature is selected so as to remove all desired components, such as fuel oil, and will generally require a pressure of about 150 millimeters of mercury absolute with a residual lube oil exit temperature generally of between 460° F. and 500° F. Preferably, the volatile forecut has a flash point of less than about 116° C.

The first two stages, as previously described, can be accomplished in a single stage at this reduced pressure for removal of all components of water, gasoline, and other volatile fuels together with somewhat less volatile components, such as fuel oil. This would then necessitate further separation of the various fuels and water removed. Preferably, the used oil is distilled to remove therefrom a forecut having a viscosity less than that of lubricating oil and a flash point less than about 116° C., thereby providing a resulting residue oil containing oil of lubricating viscosity.

In the third stage, the first removal of lube oil products occurs. This stage operates in a pressure range between about 2 and 5 millimeters of mercury absolute and in a temperature range between about 265° F. and 500° F. These ranges of pressure and temperature generally provide a recovery (without recirculation) of between about 5 and 56 percent by weight of the feedstock for typical used lubricating oils. These percentages may be expected to vary based on the distillation characteristics of the feedstock in addition to the operating conditions imposed on the third-stage distillation unit. To substantially increase the removal of lube oil and additionally reduce vaporization temperatures, recirculation of the distilled product is employed. Generally the viscosity of the oil removed in the third stage is between about 60 SSU and 200 SSU at 100° F.

The recirculation of vaporized products substantially increases the recovery of lube oil through the carrier effect or partial-pressure effect. Listed in Table 1 are the improvements and associated recovery percentages based on four values of recirculation (0%, 50%, 100%, and 200%) for each of four different overhead products for a typical feedstock. One major improvement provided by recirculation of the distillate is the lowering of the effective vaporization temperature of the feedstock. This allows increased recovery and lower operating temperatures while greatly reducing the tendency for coking or cracking of the feedstock to occur. In addition, any tendency for the equipment to become fouled is also reduced. In order to more completely understand the present invention, it is important to understand the distinction between reflux and recirculation of distillate. Reflux is the principle of returning a portion of condensed overhead product from a distillation tower to the top or side of the tower. The purpose of reflux is to improve fractionation. In contrast, recirculation of distillate, as used in accordance with the present invention, is the principle of returning a portion of the condensed vapor to the feedstock whereby its "carrying" or partial pressure effect can reduce the vaporization temperature of the feedstock.

TABLE 1

| | AMOUNT OF FEEDSTOCK VAPORIZED, WEIGHT PERCENT | | | |
|---|---|---|---|---|
| ATMOSPHERIC VAPORIZING TEMPERATURE | 580° F. | 700°0 F. | 800° F. | 820° F. |
| Flash Vaporization (Feedstock-0) Recirculation) | 5.0 | 17.5 | 48.0 | 56.3 |
| 50% Recirculation | 10.0 | 27.2 | 60.5 | 68.9 |
| 100% Recirculation | 17.4 | 32.3 | 66.5 | 77.5 |
| 200% Recirculation | 22.4 | 36.2 | 70.2 | 79.8 |

Figure 2:
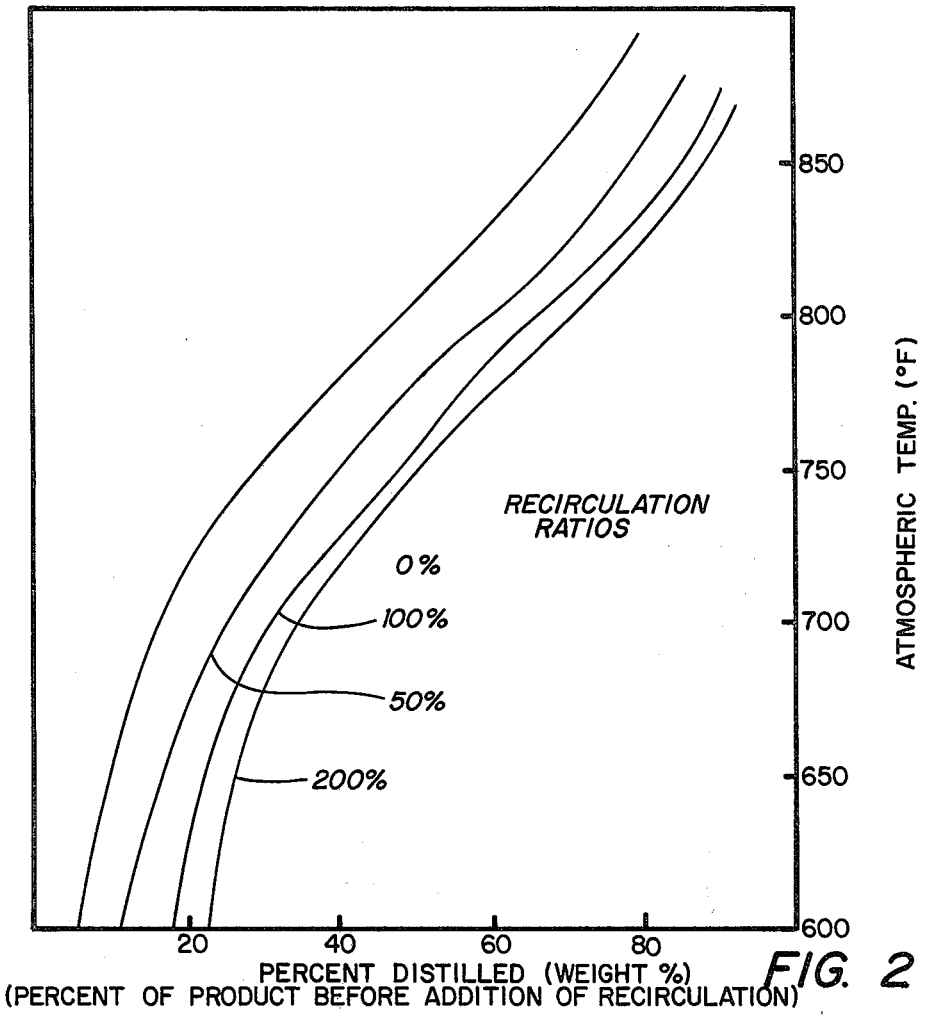
FIG. 2 is a graph depicting the effect of the recirculation ratio on the amount of used oil distilled as a function of atmospheric temperature for distillation of a typical waste oil in accordance with the invention, having water and a volatile forecut removed therefrom.

The values shown in Table 1 were obtained from the Distillation Curve depicted in FIG. 2.

Thus, the combination of pressure, temperature, and recirculation ratios outlined in Table 1 provides, for a typical waste oil, a range of lube distillate removal from the third stage between 5 to 79.8 weight percent of the feedstock to this stage. By adjusting the specific parameters of pressure, temperature, and recirculation ratio, a specific product characteristic can be obtained under lower temperature operating conditions compared to a system with no recirculation. Additionally, if product recovery in the third stage is desired without additional stages, the upper limits of recirculation can be utilized to maximize recovery.

In the fourth stage, a heavy lube oil fraction is removed as a product, which leaves behind a very heavy viscous residue (generally about 3000 to 35,000 SSU at 210° F.). Operation of the fourth stage is similar to that of the third stage in that the operating pressure, temperature, and recycle rate can be varied to produce heavy lube oil products with various properties desired by various end-users. In the fourth stage, the recycling of distilled product has the same effects as previously described for the third stage. Namely, increased recovery of lube oil products, reduction of the vaporization temperature, and reduced risks of coking and cracking of the feedstock.

Operating conditions for the fourth stage are generally a pressure of between about 0.5 to 3.0 millimeters of mercury absolute and a temperature of between about 315° F. and 600° F. The preferred operating conditions are at a pressure of about 0.5 millimeter of mercury absolute and a temperature range of 550° F. and 650° F. However, as previously stated with respect to the third stage, these conditions can be varied to alter the properties of the product or to change the fraction of the feed which is vaporized and recovered as product. Further, these parameters may change depending on the type of feedstock. Generally, the viscosity of the lube oil obtained in the fourth stage is between about 200 SSU and 1200 SSU at 100° F.

The recirculation of the vaporized product increases the recovery of heavy lube oil through the carrier effect or partial-pressure effect. Listed in Table 2 are improvements and associated recovery percentages based on four values of recirculation (0%, 50%, 100% and 200%) for each of four different overhead products for a typical feedstock. One major improvement attained by the recirculation is the lowering of the effective vaporization temperature of the feedstock. This allows increased recovery of heavy lube distilled in the fourth stage while reducing the risk of coking, cracking, and fouling.

TABLE 1

| | AMOUNT OF FEEDSTOCK VAPORIZED, WEIGHT PERCENT | | | |
|---|---|---|---|---|
| ATMOSPHERIC VAPORIZING TEMPERATURE | 800° F. | 850°0 F. | 900° F. | 940° F. |
| Flash Vaporization (No Recirculation) | 16.4 | 40.5 | 62.2 | 77.5 |
| 50% Recirculation | 20.7 | 47.2 | 66.9 | 78.0 |
| 100% Recirculation | 22.7 | 51.0 | 71.5 | 81.0 |
| 200% Recirculation | 24.0 | 52.7 | 73.9 | 82.7 |

Figure 3:
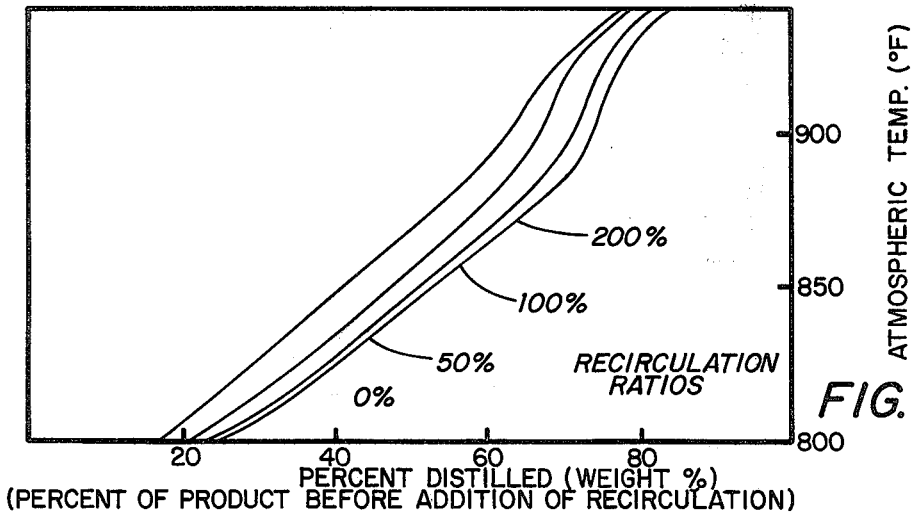
FIG. 3 is a graph depicting the effect of the recirculating ratio on the amount of used oil distilled as a function of atmospheric temperature for distillation of the heavy fraction obtained in accordance with the present invention.

The values set forth in Table 2 were obtained from the Distillation Curve set forth in FIG. 3. A variable recirculation rate capability together with changes in pressure and temperature allow for achieving maximum recovery of heavy lube oil in stage 4 of the process.

In accordance with the preferred embodiment of the present invention, the distillation in stages 3 and 4 is performed in an agitated thin film evaporator or a wiped-film evaporator or any other suitable heat transfer device.

The process can be more completely understood by reference to FIG. 1, which is a schematic depiction of the preferred embodiment of the process. Waste oil feedstock is pumped through a line 10 and heated by a heat exchanger 12 to a temperature in the range of between about 100° F. and 200° F. Thereafter, the feedstock exits heat exchanger 12 and enters a line 14. Upon exiting line 14, the feedstock enters a first-stage evaporator 16 that generally operates at a near atmospheric pressure. First-stage evaporator 16 heats the feedstock to a temperature in the range of between about 220° F. and 400° F. so as to remove essentially all water, gasoline, and other volatile components. The water, gasoline, and other volatile components that are removed from the feedstock exit through a line 18 and are condensed and cooled with a heat exchanger 20. Thereafter, the water, gasoline, and other volatiles that have been removed from the feedstock can be separated into fuel and water by conventional separation techniques.

The oil that exits the first stage is pumped through a line 22 and is heated by a heat exchanger 24 to a temperature in the range of between about 300° F. and 400° F. After heating in heat exchanger 24, the oil flows through a line 26 and into the second stage.

In the second stage of the process, the oil is treated in a second stage evaporator 28. Second stage evaporator 28 operates at a reduced pressure, generally in the range of between about 20 to 150 millimeters of mercury absolute. In the second stage, the oil is heated to a temperature in the range of between about 250° F. and 500° F. Second stage evaporator 28 removes by vaporization the heavier fuel oil components present in the waste oil reaching the second stage. The heavier fuel that is removed in this stage exits second stage evaporator 28 through line 30 and is thereafter condensed and cooled in a heat exchanger 32. The oil that has not been removed from the second stage exits second stage evaporator 28 through line 34. The oil in line 34 flows through a line 35, is heated in a heat exchanger 36 and exits heat exchanger 36 into a line 38. Thereafter, the oil enters the third stage 40 for further treatment. Heat exchanger 36 heats the oil to a temperature generally in the range of between about 350° F. and 450° F.

A third stage evaporator 40 as previously described is utilized and operates at a reduced pressure, generally in the range of between about 2 and 5 millimeters of mercury absolute at a temperature of between about 265° F. and 500° F. Light lube oil is vaporized in third stage evaporator 40 and exits into a line 42. Line 42 carries the light lube oil that has been vaporized into a heat exchanger 44 where the vaporized light lube oil is condensed and cooled to a temperature that is substantially the same temperature as line 34. This resultant light lube oil product then exits heat exchanger 44 and enters a line 46. Line 46 is split into two separate lines, 48 and 50. It is this split of line 46 that forms the recirculation of the light lube oil into the input to the third stage through line 48 and then line 35, mixing with the product in line 34. Thus, it is necessary to have a suitable valve or other arrangement so that the desired split of line 46 can be attained. The light lube oil entering line 48 is the oil that is recirculated and is combined with the waste oil exiting line 34 to form line 35. The desired recirculation percentage of line 48, as compared to line 34, is a controlled flow as determined by desired operating parameters. Preferably, the flow in line 48 can be changed from about 0 to about 300 weight percent of the flow in line 34. Thus, the feed in lines 35 and 38 consists of the combination of lines 34 and 48. For example, if 100% recirculation is desired, the weight flow in line 34 equals the weight flow in line 48. The light lube oil that forms line 50 is further cooled in a heat exchanger 52.

The residual product of the third stage evaporation exits third stage evaporator 40 and enters line 54 where it is mixed with a line 56 to form a line 58 that enters a heat exchanger 60. Line 56 is the recirculation line of the fourth stage evaporation. Heat exchanger 60 heats the product in line 58 to a temperature in the range of between about 400° F. and 490° F. The product then exits heat exchanger 60 and enters a line 62 that feeds into a fourth stage evaporator 64. Fourth stage evaporation 64 operates at a reduced pressure, generally in the range of between about 0.5 and 3 millimeters of mercury absolute and at temperatures in the range of between about 315° F. and 630° F. The heavy lube oil vaporized in the fourth stage is removed from fourth stage wiped-film evaporator 64 through a line 66 and is condensed and cooled with a heat exchanger 68 to a temperature that is substantially the same temperature as the temperature of line 54. This product of heavy lube oil is then directed through a line 70 where it is split into two lines, 56 and 72. As previously discussed with respect to the third stage, the desired recirculation percentage is determined by the flow rate of line 56 and line 54. These are controlled flows as determined by desired operating conditions. The flow rate of line 56 can preferably be changed from about 0 to about 300 weight percent based on the flow of line 54. The flow not needed for recirculation is then subcooled in a heat exchanger 74 and may be transferred via a line 76 to storage to await further treatment or for use. The residual product of the fourth stage exits fourth stage evaporator 64 into a line 78 where it is transferred to storage.

Steps of final polishing for color and removal of impurities that may remain in the heavy and light oils may be required to achieve a lubricating oil for use in industry with characteristics near, equal, or better than virgin lubricating oil.

While the invention has been described with respect to preferred embodiments, it is to be understood that various modifications thereof will now be apparent to one skilled in the art, and such modifications as fall within the scope of the appended claims are intended to be covered thereby.

We claim:

1. A method of rerefining used oil containing lubricating oil comprising:

(a) removing from the used oil a volatile forecut to provide a resulting oil containing lubricating oil; and (b) evaporating the resulting oil in an evaporator unit at reduced pressure, greater than about 2.0 millimeters of mercury, to form heavy and light fractions, with a portion of said light fraction recycled and mixed into the resulting oil prior to the resulting oil entering the evaporator unit, in a quantity effective for lowering the vaporization temperature of the resulting oil to reduce the tendency of fouling, coking and cracking of the resulting oil during evaporation.

2. The method as recited in claim 1 wherein the evaporator unit is an agitated thin film evaporator.

3. The method as recited in claim 1 wherein the evaporator unit is a wiped-film evaporator.

4. The method as recited in claim 1 wherein substantially all of the water, gasoline, and other similarly volatile components that may be present in the used oil have been removed prior to step (a) of claim 30.

5. The method as recited in claim 1 wherein the volatile forecut has a flash point less than about 116° C.

6. The method as recited in claim 1 wherein the evaporation in step (b) of claim 1 occurs in the temperature range of about 265° F. to 480° F.

7. The method as recited in claim 1 wherein the ratio of the resulting oil to the light fraction recycled into the resulting oil is about 4:1.

8. The method as recited in claim 1 wherein the amount of the light fraction that is recycled is between about 5% and 300% by weight of the resulting oil.

9. The method as recited in claim 1 wherein said light fraction is light lube oil and the method further comprises evaporating at reduced pressure the heavy fraction obtained from the evaporation of the resulting oil to form a heavy lube oil fraction and a residual fraction.

10. The method as recited in claim 8 wherein a portion of the heavy lube oil fraction is recycled and mixed into the heavy fraction prior to evaporation thereof in a quantity effective for lowering the vaporization temperature of the heavy fraction to reduce the tendency of coking and cracking of the heavy fraction during evaporation thereof.

11. The method as recited in claim 9 wherein the heavy fraction is evaporated in an agitated thin film evaporator.

12. The method as recited in claim 9 wherein the heavy fraction is evaporated in a wiped-film evaporator.

13. The method as recited in claim 9 wherein the evaporation of the resulting oil occurs in the range of about 2 millimeters of mercury to 5 millimeters of mercury absolute.

14. The method as recited in claim 9 wherein the evaporation of the heavy fraction occurs in the range of about 0.5 millimeters of mercury to 3.0 millimeters of mercury absolute.

15. The method as recited in claim 1 or 12 wherein the removal in step (a) of claim 1 occurs at reduced pressure in the temperature range of about 250° F. to 500° F.

16. A method for rerefining used lubricating oil comprising:

(a) removing from the used oil a volatile forecut to provide a resulting oil that contains lubricating oil;

(b) evaporating the resulting oil in an evaporator at reduced pressure in the range of about 2.0 to 5.0 millimeters of mercury absolute and within a temperature range of about 265° F. to 500° F. to form a heavy fraction and a light lube oil fraction, said light lube fraction having a viscosity of between about 60 and 200 SSU at 100° F., with a portion of said light lube oil fraction being recycled and mixed into the resulting oil, prior to evaporation thereof, in a quantity effective for lowering the vaporization temperature of the resulting oil to reduce the tendency of fouling, coking and cracking of the resulting oil during evaporation;

(c) evaporating the heavy fraction in an evaporator obtained from the evaporation of the resulting oil to form a heavy lube fraction and a residual fraction, the evaporation of the heavy fraction occurring at reduced pressure within a range of between about 0.5 millimeters of mercury and 3.0 millimeters of mercury absolute and within a temperature range of about 315° F. and 600° F., with a portion of the heavy lube fraction being recycled and mixed into the heavy fraction, prior to evaporation thereof, in a quantity effective for lowering the vaporization temperature of the heavy fraction to reduce the tendency of coking and cracking of the heavy fraction during evaporation thereof.

17. The method as recited in claim 16 wherein the heavy fraction is evaporated with a wiped-film evaporator.

18. The method as recited in claim 16 wherein the amount of light lube oil fraction that is recycled is between about 5% and 300% by weight of the resulting oil and the amount of heavy lube fraction that is recycled is between about 5% and 300% by weight of the heavy fraction.

19. In a process for rerefining used lubricating oil where it is desired to vary the range of lube oil evaporated in an evaporation step, the improvement comprising evaporating in an evaporator the used lubricating oil to form heavy and light fractions at reduced pressure within the range of about 2.0 to 5.0 millimeters of mercury absolute and at elevated temperature within the range of about 265° to 480° F., with a portion of said light fraction being recycled and mixed into the used oil prior to evaporation thereof, in a quantity effective for lowering the vaporization temperature to a desired level for reducing the tendency of fouling, coking and cracking of the used oil during evaporation and to vaporize a desired amount of used oil.

20. In a process for rerefining used lubricating oil, a method of lowering the vaporization temperature of the used lubricating oil and of reducing coking, cracking and fouling tendencies comprising evaporating in an evaporator the used lubricating oil to form heavy and light fractions in which a portion of the light fraction is recycled and mixed into the used oil prior to evaporation of the used oil in a quantity effective for vaporizing a desired amount of the used lubricating oil feed and lowering the effective vaporization temperature thereof.

* * * * *

UNITED STATES PATENT AND TRADEMARK OFFICE

CERTIFICATE OF CORRECTION

PATENT NO. : 4,342,645

DATED : August 3, 1982

INVENTOR(S) : Laird C. Fletcher and Harold J. Beard

It is certified that error appears in the above—identified patent and that said Letters Patent is hereby corrected as shown below:

Column 4, line 60, after "700°" delete "0" and insert --F.--;

Column 4, line 61, delete "F.";

Column 4, line 63, ")" should be deleted after "0".

Column 5, line 54, "TABLE 1" should be --TABLE 2--;

Column 5, line 59, after "850°" delete "0" and insert --F.--;

Column 5, line 60, delete "F.".

Column 7, lines 23 and 24, "evaporation" should be --evaporator--.

Column 8, line 12, "30" should be --1--.

Signed and Sealed this

Eleventh Day of January 1983

[SEAL]

Attest:

GERALD J. MOSSINGHOFF

Attesting Officer

Commissioner of Patents and Trademarks